US012654283B1

(12) United States Patent
Perrett et al.

(10) Patent No.: US 12,654,283 B1
(45) Date of Patent: Jun. 16, 2026

(54) DUST ABATEMENT FOR A CONCRETE CUTTING TOOL

(71) Applicant: Precision Concrete Cutting, Inc., Provo, UT (US)

(72) Inventors: Miles Perrett, Pleasant Grove, UT (US); Andrew Campbell, Nephi, UT (US)

(73) Assignee: Precision Concrete Cutting, Inc., Provo, UT (US)

( * ) Notice: Subject to any disclaimer, the term of this patent is extended or adjusted under 35 U.S.C. 154(b) by 0 days.

(21) Appl. No.: 18/979,065

(22) Filed: Dec. 12, 2024

(51) Int. Cl.
*B24B 55/10* (2006.01)
*B24B 55/05* (2006.01)
*B24D 5/12* (2006.01)

(52) U.S. Cl.
CPC ..... *B24B 55/102* (2013.01); *B24B 55/052* (2013.01); *B24D 5/123* (2013.01)

(58) Field of Classification Search
CPC ..... B28D 7/02; B28D 7/046; B28D 7/043; B28D 1/046; B24B 23/028; B24B 55/052; B24B 55/102; B24B 55/10
USPC ..... 451/456, 452, 454, 461, 451
See application file for complete search history.

(56) References Cited

U.S. PATENT DOCUMENTS 3,673,744 A * 7/1972 Oimoen ..... B24B 55/102 451/353
3,935,678 A * 2/1976 Marton ..... B24B 55/102 451/359
3,987,589 A * 10/1976 Marton ..... B24B 55/102 15/385
4,622,782 A * 11/1986 Roestenberg ..... B24B 55/102 451/359
5,791,979 A * 8/1998 Duncan ..... B24B 23/028 451/359
6,027,399 A * 2/2000 Stewart ..... B24B 23/02 451/353
7,223,161 B2 * 5/2007 Kodani ..... B24B 23/028 451/354

(Continued)

FOREIGN PATENT DOCUMENTS

CN 117962142 A 5/2024
CN 118163002 A 6/2024
DE 102012001925 A1 8/2013

OTHER PUBLICATIONS

IP Australia, "Examination Report No 1," Australian Patent Application No. 2025200755, Feb. 19, 2026.

*Primary Examiner* — Makena S Markman
(74) *Attorney, Agent, or Firm* — DENTONS Durham Jones Pinegar

(57) ABSTRACT

A dust abatement device includes a frame that prevents turbulent airflow caused by rotation of a spindle of a concrete cutting tool and/or a hub that has been coupled to the spindle from reaching and spreading dust generated by cutting a substrate. The dust abatement device also includes a pliable skirt, which may prevent turbulent airflow generated by a motor of the concrete cutting tool from reaching the dust and which defines a channel that transports the dust to a dust collector of the dust abatement device. A size and a configuration of the skirt enable the use of increased diameter saw blades (e.g., about 4 inches (about 10 cm) or more) with the concrete cutting tool. Concrete cutting systems that include the dust abatement device are also disclosed, as are methods for cutting concrete while enhancing the collection of dust.

21 Claims, 7 Drawing Sheets

(56) References Cited

U.S. PATENT DOCUMENTS

| | | | | |
|---|---|---|---|---|
| 7,625,265 | B2 * | 12/2009 | Woods | B24B 55/102 451/451 |
| 8,967,729 | B1 | 3/2015 | Farris et al. | |
| 11,123,839 | B2 * | 9/2021 | Loveless | B24B 55/102 |
| 2010/0261417 | A1 * | 10/2010 | O'Shannessy | B24B 55/102 451/344 |
| 2011/0092141 | A1 * | 4/2011 | McCutchen | B24B 55/05 451/451 |
| 2012/0156974 | A1 * | 6/2012 | Kundel, Jr. | B24B 23/02 451/340 |
| 2014/0352106 | A1 * | 12/2014 | King, Jr. | B28D 7/02 15/415.1 |

* cited by examiner

DUST ABATEMENT FOR A CONCRETE CUTTING TOOL

TECHNICAL FIELD

This disclosure relates generally to devices, systems, and methods for cutting concrete and, more specifically, to devices, systems, and methods for cutting a surface of concrete to provide a smooth transition between uneven sections of concrete, such as adjacent sections of a buckled sidewalk. Even more specifically, this disclosure relates to devices, systems, and methods that minimize dust while removing material from a surface of a concrete structure, such as a section of a sidewalk.

RELATED ART

Trip hazards on sidewalks, which can be caused by uneven lifting and settling of contiguous sidewalk sections, present a safety hazard for users and a liability for municipalities. Conventionally, uneven joints caused by lifted and/or sunken sidewalk sections were addressed by demolishing, removing, and replacing one or both of the sections that define the joint. The demolition, removal, and replacement of concrete sections is time-consuming, expensive, and requires that concrete not be used (e.g., that part of a sidewalk not be used, etc.) for a prolonged period of time.

Concrete lifting processes have also been used to correct uneven sections. While concrete lifting is more effective than the demolition, removal, and replacement of concrete sections, and may require less down-time, concrete lifting is not always useful for addressing unevenness between adjacent concrete sections. In particular, concrete lifting cannot be used to correct unevenness that has been caused by factors that have already lifted one or more sections of concrete, such as the roots of growing trees and shrubberies.

The use of sawing and grinding techniques have also been used to address uneven sections of concrete. U.S. Pat. Nos. 6,827,074; 6,896,604; 7,000,606; 7,143,760; 7,201,644; and 7,402,095 disclose methods and apparatuses for cutting sections of concrete sidewalks to remove trip hazards from the concrete sidewalks. These methods include so-called "flush cutting" to remove trip hazards over some or all of the width of a sidewalk. In a flush cutting operation, a portion of one or both concrete slabs that meet at a common joint may be chamfered without necessitating the pulverization of material removed while chamfering a portion of one or both slabs adjacent to the common joint. An angle grinder, in combination with a specially-designed hub and a circular diamond-grit-edged saw blade, may be employed to chamfer the trip hazard in a flush-cutting operation.

While flush cutting techniques are useful in reducing or eliminating trip hazards, the process of cutting of the concrete may generate significant amounts of dust. Dust can cause secondary problems, such as breathing hazards. Concrete is a mixture of hydrated (i.e., crystalized) cement, aggregate (gravel) and silica sand, so the dust created contains both cement dust and silica dust. Statistical evidence has shown that the breathing of silica dust can cause lung cancer, so the saw operator and those in the vicinity of the work often take precautions to be protected from the dust.

Processes that generate large amounts of dust may be accompanied by the use of large volumes of water for cooling and to prevent the spread of the dust. The use of water to abate the dust generated by cutting or grinding concrete can be undesirable, especially in situations where large volumes of water are required, as it may be difficult to provide the necessary volume of water at the site and to discard the contaminated water.

As an alternative to the use of water, or in addition to the use of water, dust abatement shrouds or hoods may be provided over saw blades. These shrouds or hoods may prevent some dust from escaping the system, improving safety and aesthetics. However, governmental regulations of some jurisdictions require that dust be decreased to levels that are well below the capabilities of existing flush cutting techniques and equipment. For example, major cities, including San Francisco, California, and Seattle, Washington, monitor air quality, and prohibit activities that generate noticeable (e.g., to individuals, to air quality monitors mounted on lamp posts, etc.) levels of dust.

Systems of the type disclosed by U.S. Pat. No. 11,628,596 have been developed to enhance dust collection, meeting the stringent requirements of municipalities like San Francisco and Seattle. However, undesirable amounts of dust may still escape into the environment. During concrete cutting, a saw blade with a diameter of about two inches may rotate at a rate of about 7,000 rpm. As the saw blade rotates, the hub and bolts that secure it to the spindle of an angle grinder or other cutting tool generate turbulent airflow that blows the dust in all directions. In addition to escaping a shroud over the saw blade, the dust may clog the passage to a vacuum that draws dust from the shroud.

SUMMARY

A dust abatement device of this disclosure is designed for use with a concrete cutting tool, such as an angle grinder. The dust abatement device includes a frame, a dust collector, and a skirt, or shroud.

The frame is securable to a base of a body the concrete cutting tool. The frame is positionable around the spindle, or an arbor, of the concrete cutting tool and a hub and bolts that couple a saw blade to the spindle. The frame prevents turbulent airflow generated by rotation of the spindle and the hub and bolts from reaching dust generated from cutting concrete with the circular saw blade. The frame may include one or more baffles, such as a rear guard and a front guard. The front guard may be curved, with a front surface of the front guard having a convex (i.e., outwardly curved) shape. Optionally, the frame carries a positioner that facilitates orientation of the circular saw blade relative to a surface of the concrete to enable cutting of the concrete at an appropriate angle. The frame also carries the dust collector.

The dust collector includes an intake oriented to collect dust generated by the circular saw blade; thus, the intake may be oriented somewhat opposite from the direction in which the circular saw blade rotates. A conduit of the dust collector extends from the intake, somewhat upwardly and rearwardly, to an outlet. The outlet may facilitate coupling of the dust collector to a hose, which may convey the dust to a receptacle, such as a receptacle of a vacuum.

The skirt, or shroud, covers the frame and extends beyond a majority of the frame. The skirt may be flexible to enable it to lay flat against the concrete as the surface of the concrete is cut to at least partially containing the dust generated while cutting the concrete between the exterior of the frame and outer portions of the skirt. The skirt may have sufficient rigidity to maintain a three-dimensional shape that defines a channel in front of the front guard of the frame. The channel and the convex curvature of the front guard may enhance suction, or a vacuum, applied by the dust collector to the channel, enhancing the rate at which dust is drawn out of the skirt and the effectiveness with which the dust is collected. The skirt also isolates the dust generated from cutting the concrete with the circular saw blade from turbulent airflow generated by the concrete cutting tool to cool its motor. Together, the frame and the skirt prevent turbulent airflow from the concrete cutting tool from scattering the dust and may amplify the amount of suction generated by the vacuum.

A concrete cutting system of this disclosure may include the dust abatement device and a concrete cutting tool, such as an angle grinder, with a circular saw blade for cutting concrete coupled to a spindle of the concrete cutting tool. A hub and bolts couple the circular saw blade to a spindle of the concrete cutting tool. The circular saw blade may comprise a so-called diamond blade. A diameter of the circular saw blade may exceed the diameters of saw blades that have been used conventionally to cut chamfers that level adjacent sections of concrete with uneven surfaces. For example, the saw blade may have a diameter of about 4 inches or more (e.g., about 4 inches (about 10 cm), about 5 inches (about 13 cm), about 6 inches (about 15 cm), about 7 inches (about 18 cm), about 8 inches (about 20 cm), etc.). The dust abatement system is assembled with the concrete cutting tool, with the frame of the dust abatement system being located between the base of the body of the concrete cutting tool and a circular saw blade that has been coupled to a spindle of the concrete cutting tool, the dust collector being positioned laterally adjacent to the frame and the body of the concrete cutting tool, and the skirt covering portions of the frame and the circular saw blade that extend laterally beyond the body of the concrete cutting tool. Optionally, the concrete cutting system may include a hose, which may include a first end coupled to a coupler of the dust collector, and a vacuum, which may be coupled to a second end of the hose.

A method for cutting concrete may include isolating turbulent airflow generated by a concrete cutting tool (e.g., turbulent airflow generated by the concrete cutting tool to cool its motor; turbulent airflow generated as a spindle of the concrete cutting tool rotates a hub and bolts that secure a circular saw blade to the spindle, etc.) from dust generated while cutting concrete with the concrete cutting tool. The method also includes collecting the dust generated by the concrete cutting tool. The method may further include enhancing suction of a vacuum that collects dust generated by the concrete cutting tool as it cuts concrete.

Other aspects of the disclosed subject matter, as well as features and advantages of various aspects of the disclosed subject matter, should be apparent to those of ordinary skill in the art through consideration of the ensuing description, the accompanying drawings, and the appended claims.

DETAILED DESCRIPTION

Figure 1:
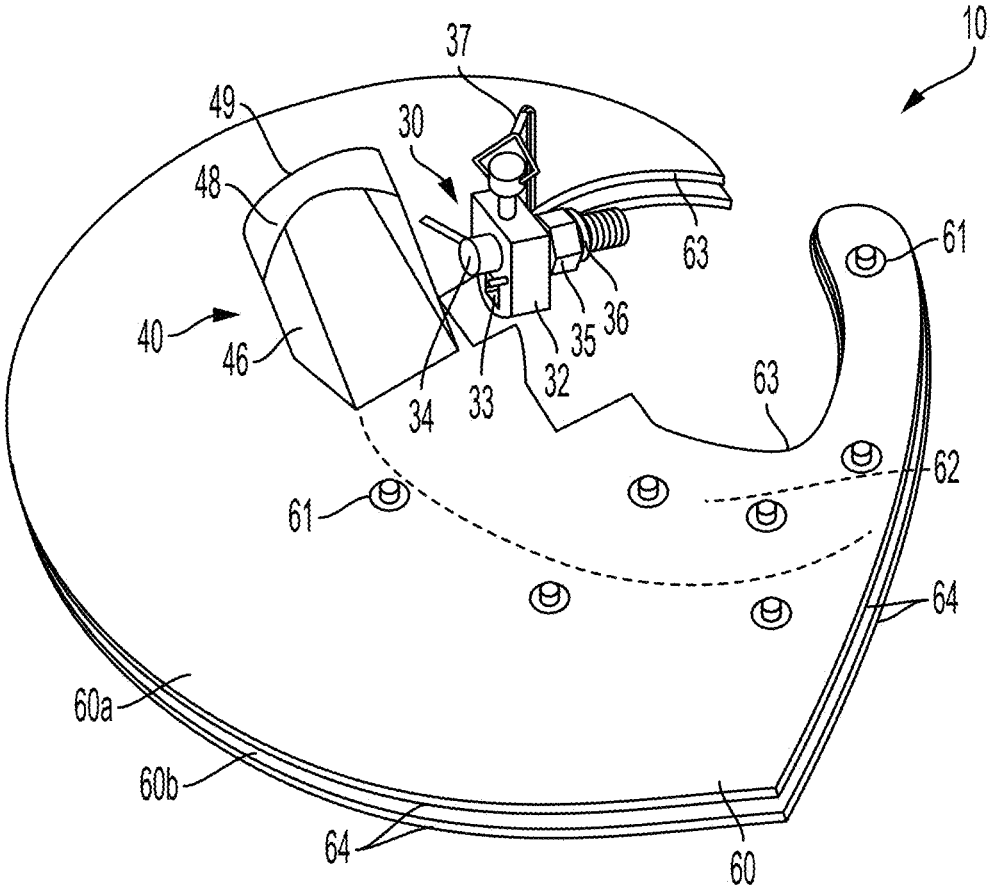
FIG. 1 is a perspective view of a dust abatement device for use with a concrete cutting tool.
Figure 2:
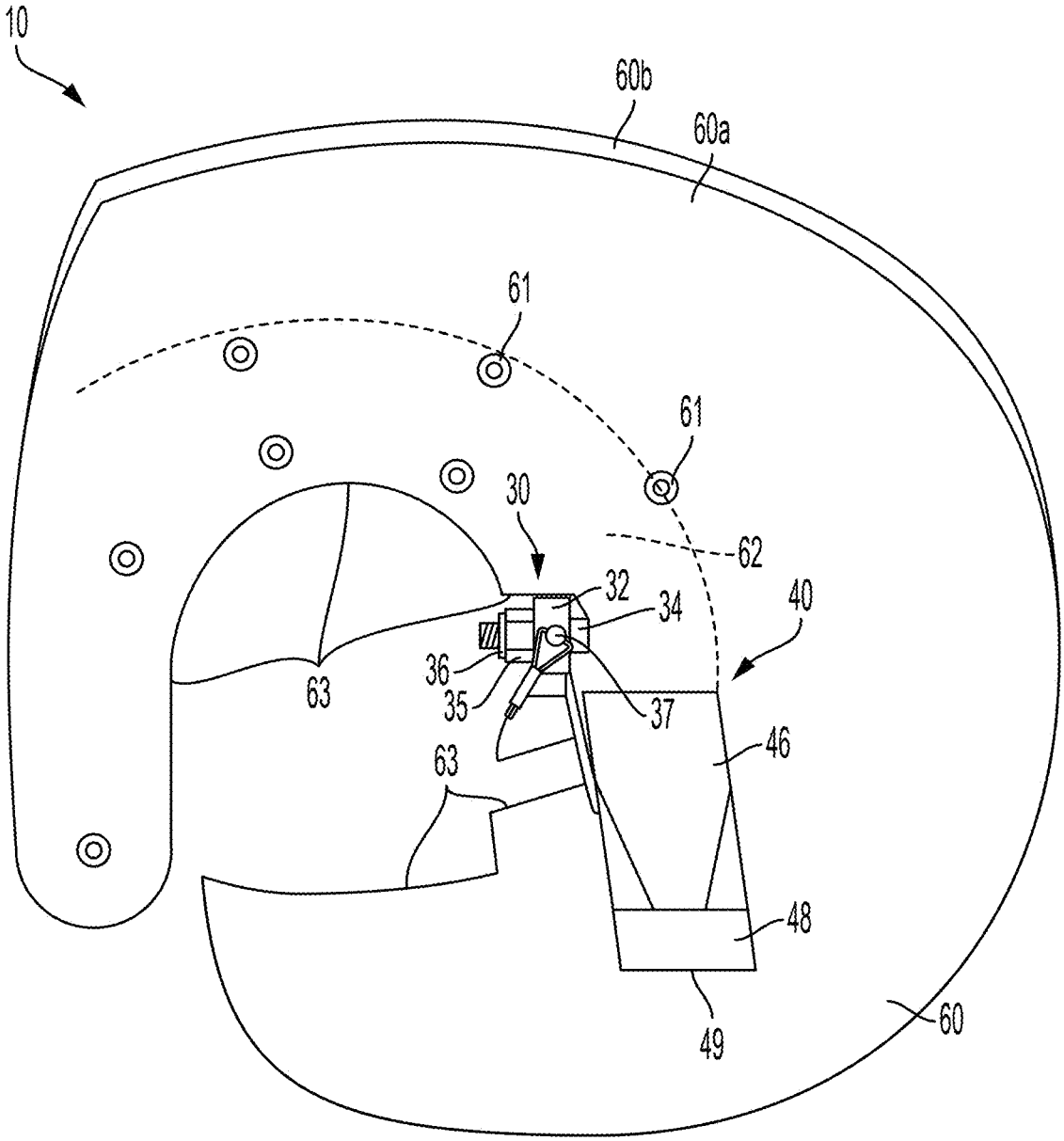
FIG. 2 is a top view of the dust abatement device shown in FIG. 1.
Figure 3:
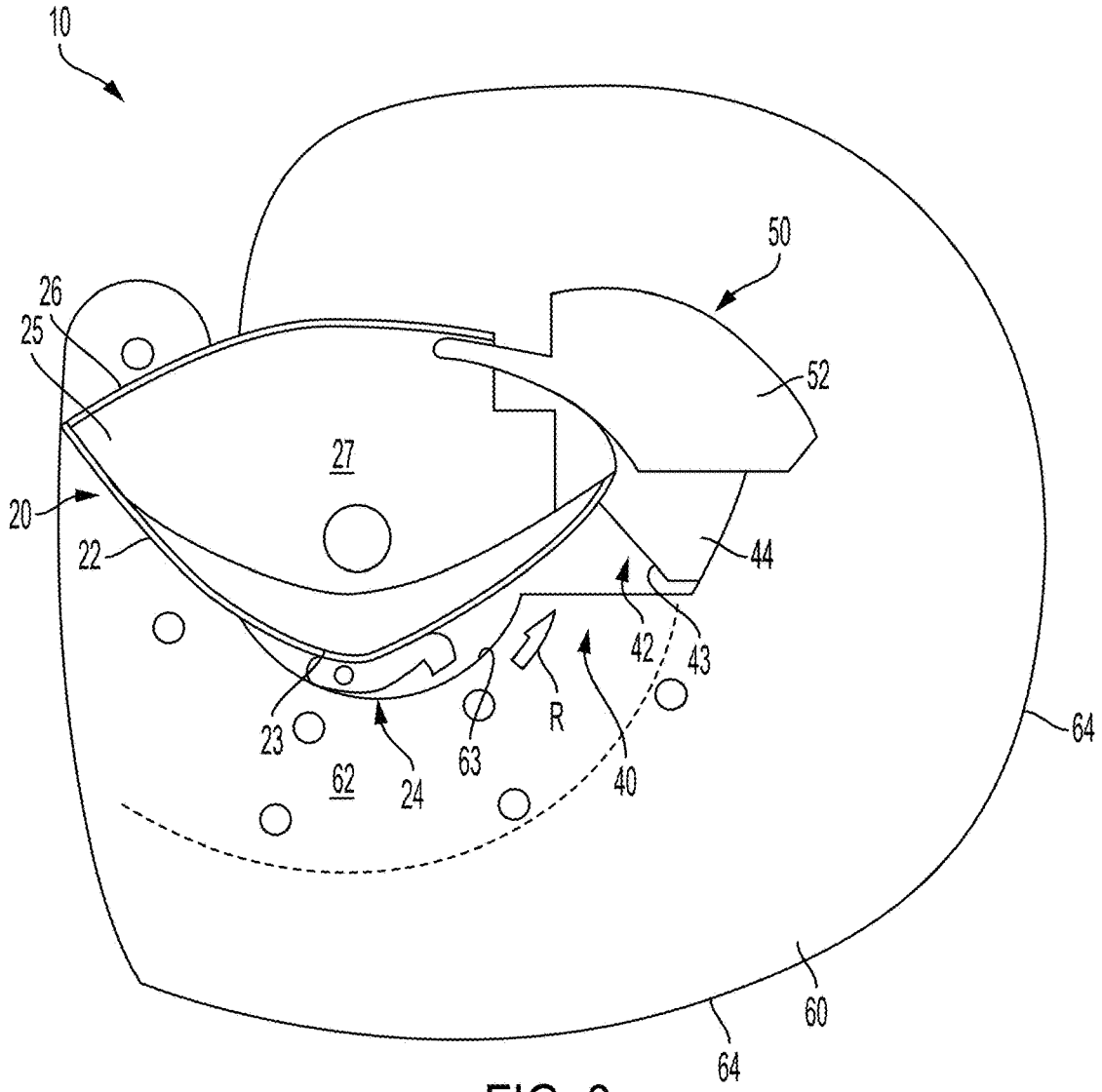
FIG. 3 is a bottom view of the dust abatement device shown in FIG. 1.

With reference to FIGS. 1-3, an embodiment of a dust abatement device 10 is illustrated. The dust abatement device 10 includes a frame 20, a dust collector 40, and a skirt 60. The dust collector 40 is positioned adjacent to the frame 20 and extends away from the frame 20. The skirt 60 is positioned over the frame 20 and extends laterally beyond the frame 20.

As shown in FIG. 3, the frame 20 of the dust abatement device 10 includes a front guard 22 and a coupler 24. The front guard 22 is oriented to extend downwardly away from the base of the body of the concrete cutting tool (not shown). A height of the front guard 22 may be slightly less than a distance a circular saw blade will be spaced apart from the base of the body of the concrete cutting tool. The front guard 22 may be curved. A front surface of the front guard 22 may have a convex curvature. The height of the front guard 22 may enable the circular saw blade to rotate freely beneath the frame 20 while the height and curvature of the front guard 22 may substantially cover a spindle of the concrete cutting tool and blade couplers that secure the circular saw blade to the spindle of the concrete cutting tool from the front and partially cover the spindle and blade couplers from the sides. Thus, the front guard 22 may substantially block turbulent airflow generated by the spindle, hub, and bolts from moving beyond a front of the frame 20.

As shown in FIG. 3 and further depicted by FIGS. 1 and 2, the coupler 24 may extend upwardly from a front 23 of the front guard 22. A configuration of the coupler 24 may enable it to engage a feature of the concrete cutting tool or a complementary coupler securable to the body of the concrete cutting tool. The coupler 24 may be part of a concrete cutting tool with which the front guard 22 may be assembled. Alternatively, the coupler 24 may be coupled to the front 23 of the front guard 22.

With continued reference to FIG. 3, in some embodiments, the frame 20 may also include a top 25 and a rear guard 26. The top 25 and rear guard 26 may be parts of a concrete cutting tool with which the front guard 22 may be assembled. Alternatively, the front guard 22, coupler 24, top 25, and rear guard 26 may be preassembled for subsequent assembly with a concrete cutting tool.

The top 25 of the frame 20 is positioned or positionable against a base, or a bottom of the body of the concrete cutting tool. The rear guard 26 may be oriented substantially perpendicular to the top 25. The rear guard 26 may be curved to converge with the front guard 22. A height of the rear guard 26 may be slightly less than a distance a circular saw blade will be spaced apart from the base of the body of the concrete cutting tool. The height of the rear guard 26 may enable a circular saw blade to rotate freely beneath the frame 20 while the height and curvature of the rear guard 26 may substantially cover a spindle of the concrete cutting tool and blade couplers that secure the circular saw blade to the spindle of the concrete cutting tool from behind and partially cover the spindle and blade couplers from the sides. Thus, the rear guard 26 may substantially block turbulent airflow generated by the spindle, hub, and bolts from moving beyond a rear of the frame 20. Together, the front guard 22 and rear guard 26, along with the top 25, may define an interior 27 of the frame 20.

The coupler 24 may couple the top 25 of the frame 20 to the base of the body of the concrete cutting tool. The coupler 24 may comprise a clamp that secures to a complementary feature (e.g., a top 25 and rear guard 26 of the concrete cutting tool, etc.) to the base of the body of the concrete cutting tool.

Figure 4:
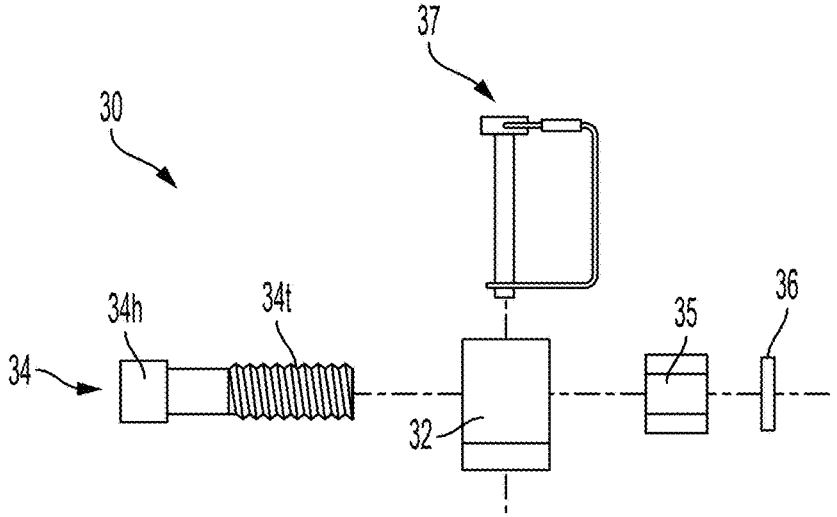
FIG. 4 depicts an embodiment of a coupling system that secures the dust abatement device to a concrete cutting tool.

Another coupler 30 may couple the top 25 of the frame 20 to the base of the body of the concrete cutting tool. The coupler 30 may include a receiver 32 that extends upwardly from the frame 20 and/or the dust collector 40. In a specific embodiment, which can be seen in FIGS. 1 and 2, as well as in FIG. 4, the receiver 32 may include a portion with a shape that resembles a C. An opening 33 of that portion of the receiver 32 may receive a portion of a bolt 34 that can engage a threaded receptacle in a side of the concrete cutting tool (e.g., a threaded receptacle for a handle, etc.). More specifically, the opening 33 may receive a portion of the bolt 34 between a head 34*h* of the bolt 34 and a nut 35 that has been screwed onto a threaded portion 34*t* of the bolt 34. The nut 35 and an adjacent washer 36, which may also be placed on the threaded portion 34*t* of the bolt 34, may be used to lock the bolt 34 into the threaded receptacle of the concrete cutting tool. The upper and lower arms of the C-shaped portion of the receiver 32 may include aligned holes therethrough, which may receive a retainer 37, such as the D clip shown in FIGS. 1, 2, and 4. The retainer 37, the head 34*h* of the bolt 34, and the nut 35 may secure the bolt 34 in place within the opening 33 of the receiver 32.

Referring to FIG. 3, the dust collector 40 of the dust abatement device 10 is positioned adjacent to an outer surface of the front guard 22 of the frame 20, at a side or an end of the front guard 22. The dust collector 40 includes an inlet 42, a conduit 46, and an outlet 48. The inlet 42, which is shown in FIG. 3, may comprise an enlarged opening 43 that faces, or is opposed to, a direction of rotation R of the circular saw blade. As illustrated, the opening 43 may face in a somewhat clockwise orientation relative to the direction of rotation of the spindle and the circular saw blade of the concrete cutting tool, opposite the counterclockwise rotation of a spindle and the circular saw blade. The opening 43 may also face downwardly (i.e., toward a location where a top of a circular saw blade will reside). Thus, the opening 43 of the inlet 42 may capture dust generated as the circular saw blade cuts concrete. From the opening 43, the inlet 42 includes a tapered portion 44 that extends outward from the frame 20 and upward. The tapered portion 44 extends to the conduit 46, shown in FIGS. 1 and 2, which extends somewhat rearwardly to the outlet 48, also shown in FIGS. 1 and 2. The outlet 48 includes an opening 49 through which dust exits the dust collector 40.

With returned reference to FIG. 3, an optional positioner 50 may be located beneath at least a portion of the inlet 42 and/or tapered portion 44 of the dust collector 40. The positioner 50 may include a lower surface 52 that facilitates orientation of the concrete cutting tool and the circular saw blade at an appropriate angle for removing a portion of a surface of a section of concrete to create a smooth transition between adjacent, uneven sections of concrete. Thus, the lower surface 52 of the positioner may be oriented at the appropriate angle relative to the saw blade. The orientation of the lower surface 52 may be fixed or it may be adjustable. The positioner 50 may also stabilize the concrete cutting tool while cutting the concrete.

The skirt 60 of the dust abatement device 10 is positioned over an outer periphery of the top 25 of the frame 20 and over the dust collector 40. The skirt 60 may comprise a flexible member that, along with the front guard 22, defines a channel 62 along the front of the convexly shaped front surface of the front guard 22 of the frame 20 and extending to the opening 43 of the inlet 42 of the dust collector 40. More specifically, the skirt 60 may include a pair of overlapping members 60*a* and 60*b* that have sufficient rigidity and that are secured together (e.g., by couplers 61, such as the depicted rivets, etc.) in a manner that prevents the skirt 60 from lying flat against a planar surface and imparts the skirt 60 with a three-dimensional shape that defines the channel 62. As the dust flows through the channel 62, the convex curvature of the front surface of the front guard creates a region of lower pressure, known as the Coanda effect, enhances the suction applied by a vacuum to the dust collector 40, enabling the vacuum to collect dust more efficiently and more effectively. For example, the Coanda effect generated by the channel 62, along with the shielding of turbulence provided by the front guard 22, amplifies a suction speed of about 80 mph (about 36 m/s) at the intake 42 to about 170 mph (about 76 m/s).

Each member 60*a*, 60*b* may comprise a pliable sheet with a sufficient hardness and thickness to hold its shape. Without limitation, each member 60*a*, 60*b* may comprise a sheet of rubber, such as ethylene propylene diene monomer (EPDM). Other examples of suitable materials include but are not limited to thermoplastic polyolefin (TPO), flexible polyvinylchloride (PVC), silicone, polyurethane, neoprene, and the like.

Each member 60*a*, 60*b* may have a thickness of about one-sixteenth inch (about 1.6 mm) to about three-sixteenth inch (about 4.8 mm) (e.g., one-sixteenth inch, one-eighth inch (about 3.2 mm), three-sixteenth inch, etc.), or a thickness of about 1 mm to about 5 mm (e.g., about 1 mm, about 2 mm, about 3 mm, about 4 mm, about 5 mm, etc.).

The skirt 60 may be made by cutting the two members 60*a* and 60*b* to desired shapes, The two members 60*a* and 60*b* may then be properly oriented and superimposed over a form that resembles a desired shape of the skirt 60 when in use. For example, a shape of the form may be a desired shape for the channel 62 of the skirt 60. With the two members 60*a* and 60*b* superimposed over the form, they may be attached together at a plurality of spaced apart locations, for example, with couplers 61 (e.g., the depicted rivets, etc.), that will impart the skirt 60 with some rigidity and at least partially hold the skirt 60 in the shape of the form once the skirt 60 and the attached members 60*a* and 60*b* that define the skirt 60 are removed from the form.

The skirt 60 extends laterally beyond portions of the frame 20 and the dust collector 40, with an outer periphery 64 of the skirt 60 being located well beyond the front of the frame 20 (e.g., the front guard 22) and the side of the frame 20 (e.g., the dust collector 40, etc.). Optionally, the outer periphery 64 of the skirt 60 may also be located well beyond the rear of the frame (e.g., a portion of the rear guard 26). A size and a configuration of the skirt 60 may enable the use of larger diameter saw blades (e.g., about 4 inches (about 10 cm) or larger) with a concrete cutting tool to improve the efficiency and quality of cutting while also improving dust abatement during cutting.

The skirt 60 also includes an inner periphery 63. The inner periphery 63 has a shape that enables it to be positioned against outer surfaces and/or features of the concrete cutting tool.

Figure 5:
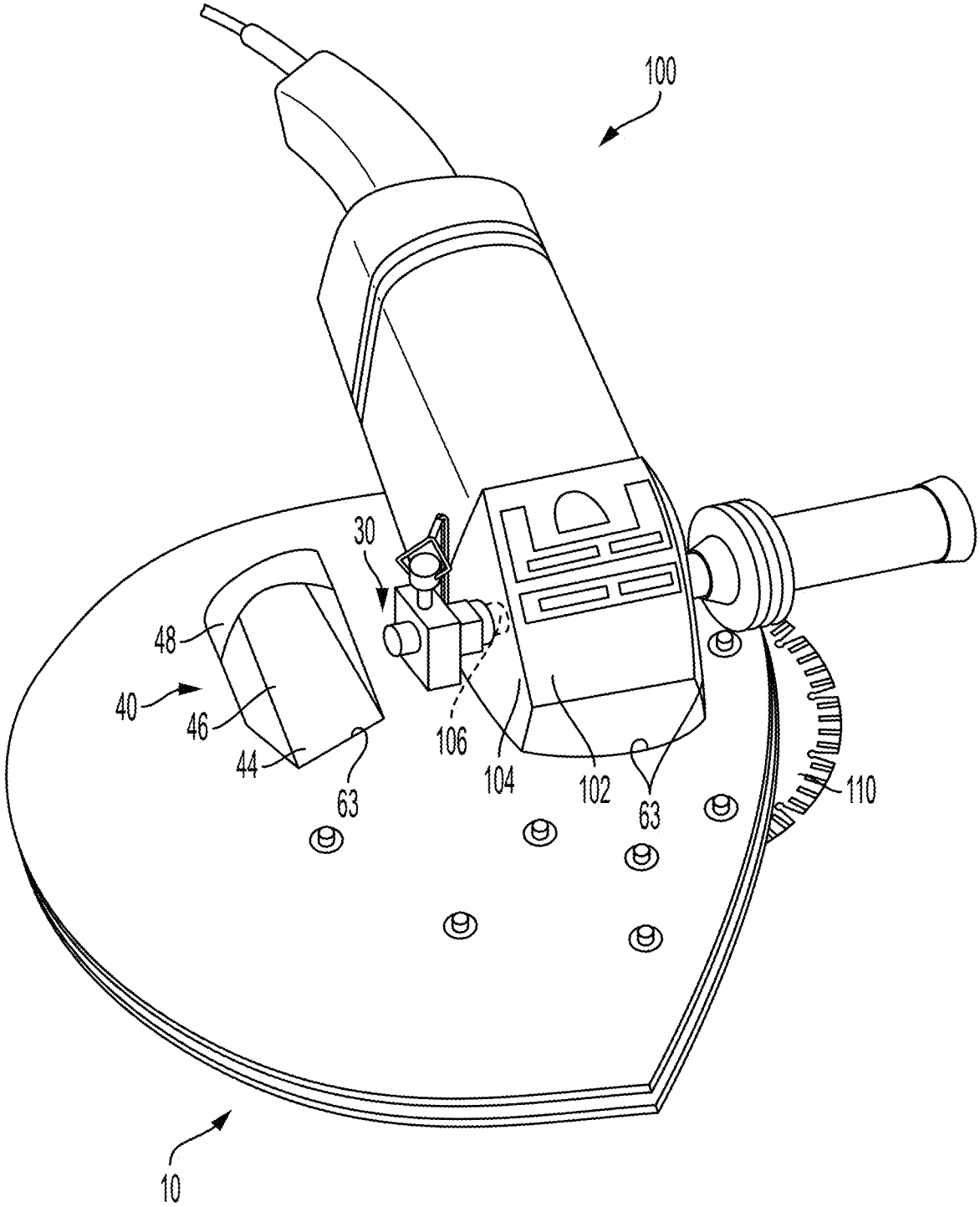
FIG. 5 is a perspective view showing the dust abatement device of FIG. 1 assembled with an embodiment of a concrete cutting tool.
Figure 6A:
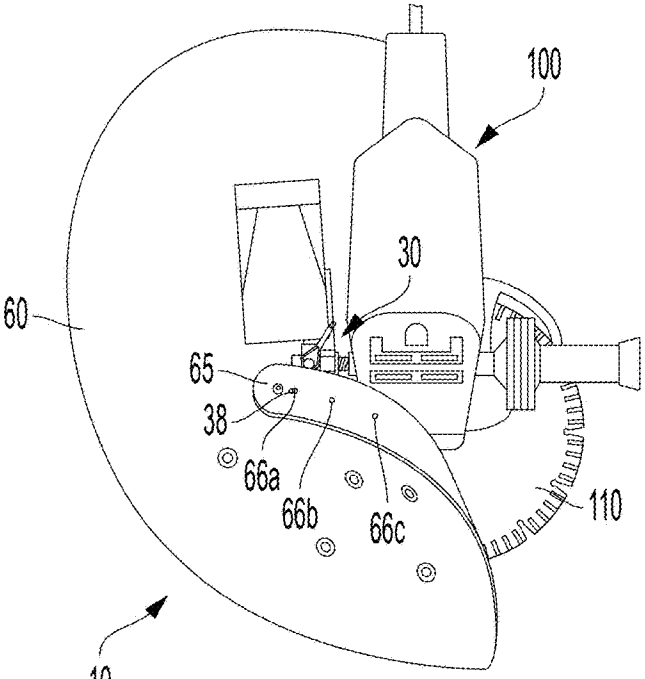
FIG. 6A is a top view of the assembly shown in FIG. 5, showing the skirt of the dust abatement device in a second arrangement, in which the skirt is partially retracted, revealing a portion of the circular saw blade of the concrete cutting tool.
Figure 6B:
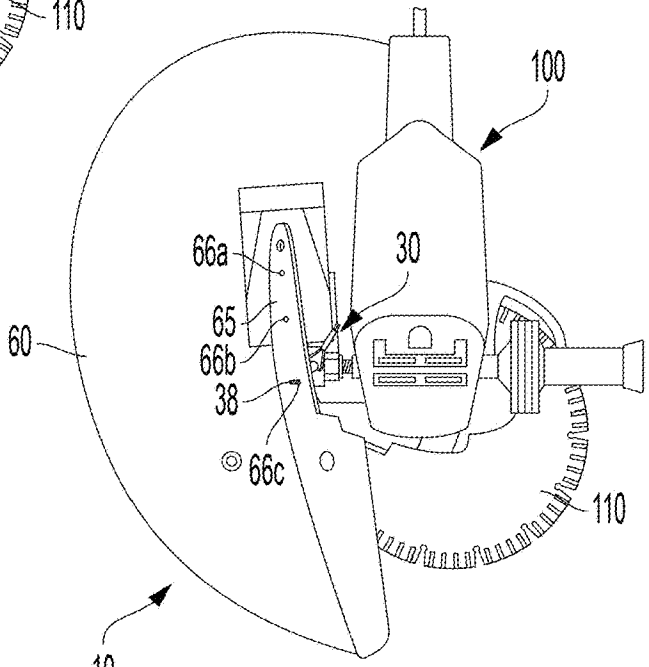
FIG. 6B is a top view of the assembly shown in FIG. 5, showing the skirt of the dust abatement device in a third arrangement, in which the skirt is more retracted that in the second arrangement shown in FIG. 6A, revealing a greater portion of the circular saw blade than that shown in FIG. 6A.
Figure 6:
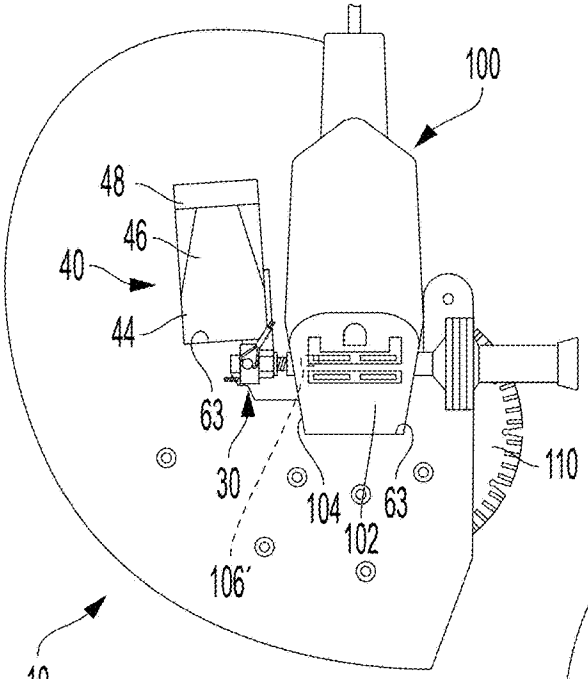
FIG. 6 is a top view of the assembly shown in FIG. 5, showing a skirt of the dust abatement device in a first arrangement that completely covers a circular saw blade of the concrete cutting tool.
Figure 7:
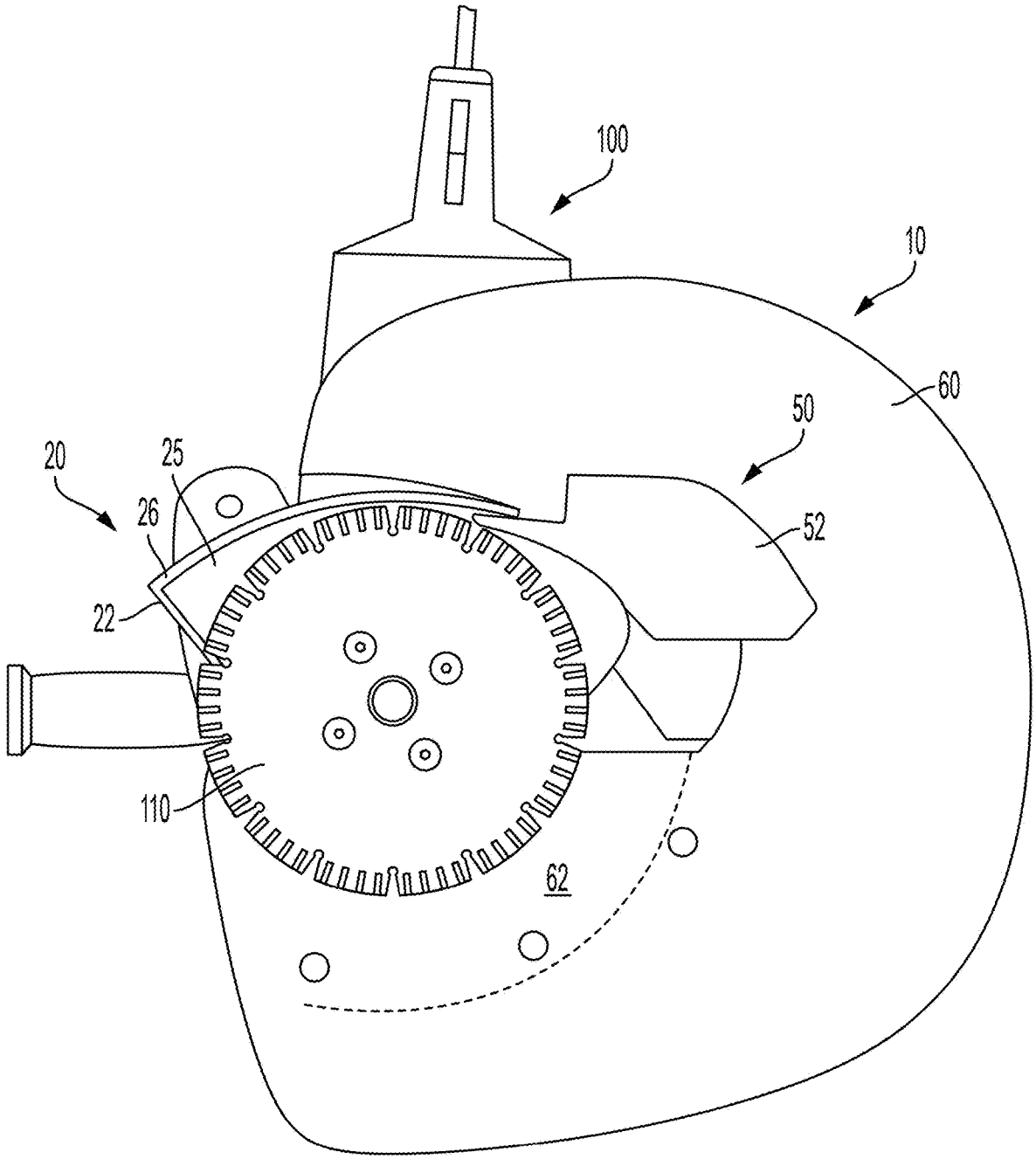
FIG. 7 is a bottom view of the assembly shown in FIG. 5.

FIGS. 5-7 show the dust abatement device 10 assembled with an embodiment of a concrete cutting tool 100. A saw blade 110 (e.g., a diamond saw blade, etc.) is also assembled with the concrete cutting tool 100. A hub and bolts may couple the saw blade 110 to a spindle of the concrete cutting tool 100. The saw blade 110 may comprise a so-called diamond blade. The saw blade 110 may have a diameter of about 4 inches or more (e.g., about 4 inches (about 10 cm), about 5 inches (about 13 cm), about 6 inches about 15 cm), about 7 inches (about 18 cm), about 8 inches (about 20 cm), etc.). The use of a saw blade 110 with a larger diameter may ease the process of cutting chamfers that have height:length ratios of 1:12 or less, which are required by some jurisdictions (e.g., by the Americans with Disabilities Act (ADA), etc.).

As illustrated by FIGS. 5 and 6, the coupler 30 at least partially secures the dust abatement device 10 to a threaded receptacle 106 in a side 104 of a body 102 of the concrete cutting tool 100. The coupler 24 (FIG. 3) may further secure the frame 20 of the dust abatement device 10 to the base of the concrete cutting tool 100. In addition, retainers (not shown) (e.g., elongated threaded elements, hooks, etc.) protruding from rear portions of the skirt 60 may engage holes (e.g., hole 66*b*) in the skirt 60 to further secure the skirt 60 to portions of the dust abatement device 10 (e.g., the frame 20, the dust collector 40, the positioner 50, etc.) beneath the concrete cutting tool 100.

The skirt 60 of the dust abatement device 10 may be positioned around the body 102, with the interior periphery 63 of the skirt 60 positioned adjacent to and abutting the body 102. The inner periphery 63 of the skirt 60 may also surround the dust collector 40 or, more specifically, the tapered portion 44 and/or conduit 46 of the dust collector 40, with the conduit 46 of the dust collector 40 extending upwardly and rearwardly over a portion of the skirt 60 to position the outlet 48 of the dust collector 40 at a location where the outlet 48 may be secured to a hose of a receptacle, such as the receptacle of a vacuum. The skirt 60 is positioned over at least a portion of the saw blade 110.

As depicted by FIGS. 6A and 6B, a portion of the skirt 60 may be pulled back to reveal more of the saw blade 110. As illustrated by FIGS. 6A and 6B, the skirt may include a side portion 65 with a series of holes 66*a*, 66*b*, 66*c* that may receive and be retained by a retainer 38 protruding from the coupler 30. Without limitation, the retainer 38 may comprise an elongated threaded element, a hook, or the like, that may be received by any of the holes 66*a*, 66*b*, or 66*c*. FIG. 6A shows the skirt 60 in a partially retracted arrangement in which a first hole 66*a* of the side portion 65 of the skirt 60 is engaged by the retainer 38, revealing a portion of the saw blade 110. FIG. 6B shows the skirt in a fully retracted arrangement, with a third hole 66*c* of the side portion 65 of the skirt 60 being engaged by the retainer 38 to reveal a greater portion of the saw blade 110. Notably, while retraction of the skirt 60 may reveal increased of the saw blade 110, which may aid in cutting a substrate at an appropriate location, the portion of the skirt 60 that remains in place over the saw blade 110 and the intake 42 of the dust collector 40 may enable the dust abatement device 10 to abate dust to substantially the same extent that it would abate dust if the skirt 60 was not retracted.

In FIG. 7, the positioning of the frame 20, including the front guard 22, the top 25, and the rear guard 26 relative to the saw blade 110 can be seen. Also shown is the location of the channel 62 of the skirt 60 in front of the front guard 22 and the saw blade 110, creating a path that leads to the intake 42 of the dust collector 40. In addition, a nonlimiting example of the location of the positioner 50 relative to the saw blade 110 can also be seen.

Figure 8:
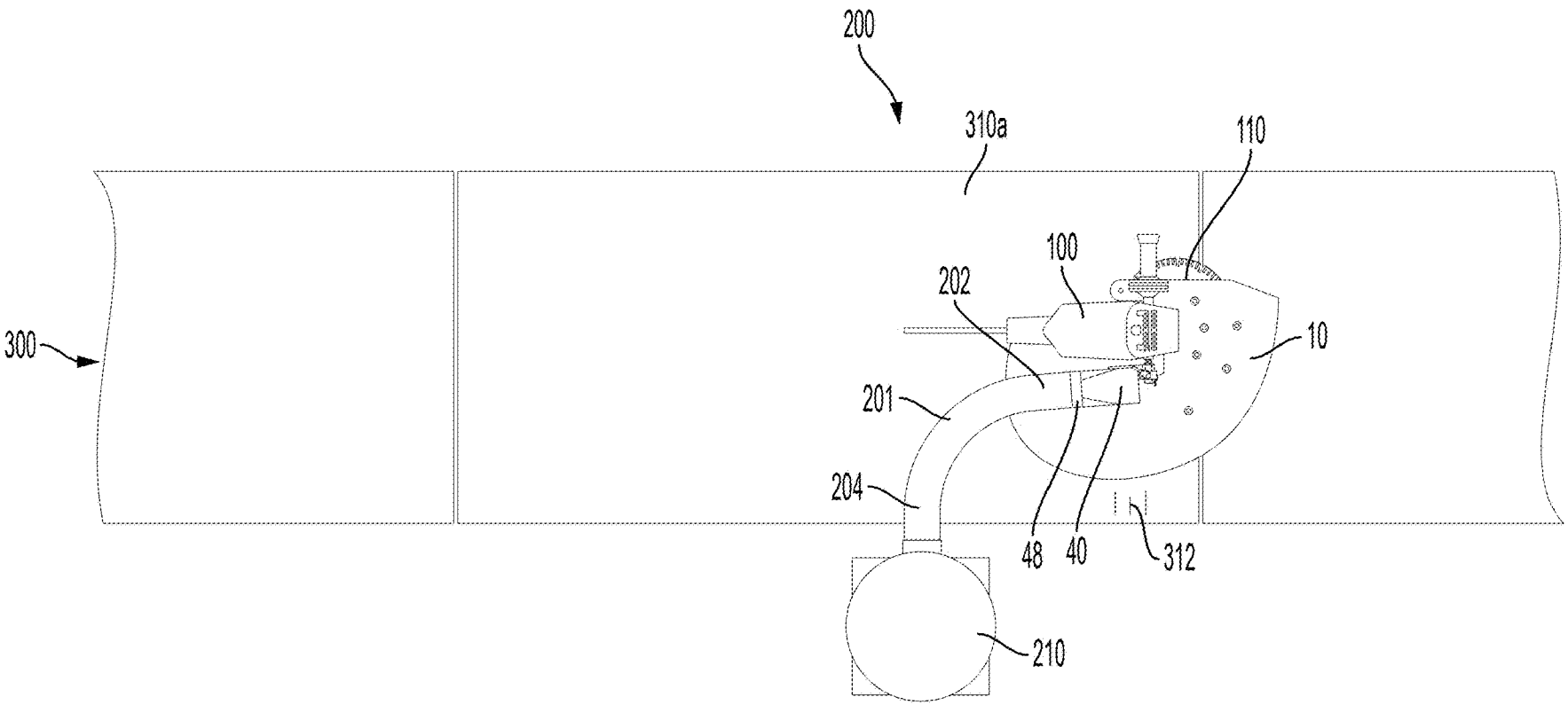
FIG. 8 depicts an embodiment of a concrete cutting system.

Turning now to FIG. 8, an embodiment of a concrete cutting system 200 is shown. The concrete cutting system 200 includes a concrete cutting tool 100 with which a saw blade 110 and a dust abatement device 10 have been assembled. In addition, the concrete cutting system includes a hose 201 with a first end 202 coupled to the outlet 48 of the dust collector 40 of the dust abatement device 10 and a second end 204 coupled to a receptacle 210, such as the receptacle of a vacuum or a vacuum system (e.g., the vacuum system of U.S. Pat. No. 11,628,596, the entire disclosure of which is hereby incorporated herein; etc.).

In use, the dust abatement device 10 may be assembled with a concrete cutting tool 100, such as an angle grinder with a saw blade 110 secured thereto. With the dust abatement device 10 in place, the concrete cutting tool 100 and saw blade 110 may be used to chamfer 312 a portion of a surface of a concrete structure, such as a section 310*a* of an uneven sidewalk 300. Referring briefly to FIGS. 3 and 7, as the saw blade 110 cuts the concrete, dust is generated. The front guard 22 and rear guard 26 of the frame 20 of the dust abatement device 10 substantially isolate turbulence generated by the spindle of the concrete cutting tool 100 (which rotates the saw blade 110) and/or a hub and bolts that couple the saw blade 110 to the spindle, preventing the turbulence from reaching and spreading the dust. In addition, the dust is confined by the skirt 60 and moves into and through the channel 62 defined by the skirt 60 and the front guard 22. The dust within the channel 62 may be drawn into the inlet 42 of the dust collector 40 of the dust abatement device 10 by the vacuum 210, which is coupled to the outlet 48 of the dust collector 40 by way of the hose 200.

Although this disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A dust abatement device for a concrete cutting tool, comprising:

a frame including a front guard and a rear guard positionable around a spindle of the concrete cutting tool to confine turbulence generated as the spindle and a hub connected to the spindle rotate;

a dust collector adjacent to the frame and including an inlet, a conduit, and an outlet; and an arcuate skirt over the frame and the inlet of the dust collector, the arcuate skirt being oriented substantially horizontally and pliable to enable a periphery of the arcuate skirt to lay flat against a surface and to enable the arcuate skirt to taper upwardly to define a channel extending over the surface, arcuately in front of the front guard to the inlet of the dust collector to receive a portion of a blade of the concrete cutting tool.

2. The dust abatement device of claim 1, wherein the arcuate skirt includes two superimposed layers of a pliable material secured to each other at spaced apart locations to impart the arcuate skirt with a three-dimensional shape, to define the channel, and to enable the periphery of the arcuate skirt to lay flat against the surface.

3. The dust abatement device of claim 1, wherein the arcuate skirt comprises a rubber.

4. The dust abatement device of claim 1, wherein the arcuate skirt is positionable in an at least partially retracted arrangement over the concrete cutting tool.

5. The dust abatement device of claim 1, further comprising:

a positioner adjacent to the frame.

6. The dust abatement device of claim 5, wherein the positioner includes a lower surface that orients the blade coupled to the spindle of the concrete cutting tool at a desired angle relative to a surface to be cut by the blade.

7. A concrete cutting system, comprising:

a concrete cutting tool;

a saw blade secured by bolts to a hub secured to a spindle of the concrete cutting tool; and a dust abatement device including:

a frame including:

a front guard in front of the spindle and over the saw blade; and a rear guard behind the spindle and over the saw blade;

a dust collector adjacent to the frame and including an inlet, a conduit, and an outlet; and a pliable skirt over the frame and the inlet of the dust collector, the pliable skirt being arcuate in shape, oriented substantially horizontally, having sufficient flexibility to enable a portion of the pliable skirt to lay flat against a concrete surface, and having sufficient rigidity to define a channel extending arcuately in front of the front guard to the inlet of the dust collector, a portion of the saw blade extending into the channel.

8. The concrete cutting system of claim 7, wherein the frame confines turbulence generated as the spindle, the hub, and the bolts rotate.

9. The concrete cutting system of claim 7, wherein the concrete cutting tool comprises an angle grinder.

10. The concrete cutting system of claim 9, wherein the saw blade has a diameter of at least 4 inches.

11. The concrete cutting system of claim 7, wherein the pliable skirt comprises two superimposed layers secured to each other at spaced apart locations to impart the pliable skirt with a three-dimensional shape, to define the channel, and to enable the portion of the skirt to lay flat against the concrete surface.

12. The concrete cutting system of claim 11, wherein the two superimposed layers are pliable and, where peripherally superimposed can lay flat against the concrete surface.

13. The concrete cutting system of claim 7, further comprising:

a vacuum; and a hose connecting the vacuum to the outlet of the dust collector of the dust abatement device.

14. A method for cutting concrete, comprising:

assembling a dust abatement device with a concrete cutting tool;

cutting a substrate with a saw blade coupled to a hub coupled to a spindle of the concrete cutting tool;

shielding dust generated while cutting the substrate from turbulence generated by the spindle and/or the hub with a pliable skirt that is arcuate in shape, oriented substantially horizontally, and has sufficient flexibility to enable a periphery of the pliable skirt to lay flat against a surface of the substrate;

transporting the dust through a channel defined by an upwardly tapered portion of the pliable skirt as the periphery of the pliable skirt lays flat against the surface of the substrate, the channel extending arcuately and receiving at least a portion of the saw blade.

15. The method of claim 14, further comprising:

collecting the dust transported through the channel.

16. The method of claim 15, wherein transporting the dust and collecting the dust comprise applying a vacuum to an end of the channel.

17. The method of claim 14, wherein transporting the dust comprises applying a vacuum to an end of the channel.

18. The method of claim 14, further comprising:

retracting a portion of the pliable skirt to reveal the saw blade; and cutting the substrate with the portion of the pliable skirt retracted.

19. The method of claim 14, further comprising:

preventing turbulence generated by a motor of the concrete cutting tool from reaching the dust generated by cutting the substrate.

20. The method of claim 14, further comprising:

placing a guide on a surface of the substrate to define an angle of the saw blade relative to the surface of the substrate.

21. The method of claim 14, wherein the pliable skirt includes two superimposed layers with sufficient flexibility to enable a periphery of the two superimposed layers to lay flat against the surface of the substrate.

* * * * *